US009905357B2

(12) United States Patent
Yen et al.

(10) Patent No.: US 9,905,357 B2
(45) Date of Patent: Feb. 27, 2018

(54) INTEGRATED CIRCUIT

(71) Applicant: Realtek Semiconductor Corporation, Hsinchu (TW)

(72) Inventors: Hsiao-Tsung Yen, Hsinchu (TW); Yuh-Sheng Jean, Hsinchu (TW); Ta-Hsun Yeh, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 15/096,296

(22) Filed: Apr. 12, 2016

(65) Prior Publication Data

US 2017/0125160 A1 May 4, 2017

(30) Foreign Application Priority Data

Oct. 30, 2015 (TW) ..... 104135797 A

(51) Int. Cl.
*H01F 27/36* (2006.01)
*H01F 5/00* (2006.01)
*H01F 27/28* (2006.01)

(52) U.S. Cl.
CPC ..... *H01F 27/362* (2013.01); *H01F 27/2804* (2013.01)

(58) Field of Classification Search
CPC .. H01F 27/362; H01F 27/2804; H01F 27/288; H01F 27/2885; H01F 17/0006; H01F 2017/008; H01F 2017/0086
USPC ..... 336/200, 232, 84 C, 84 R, 84 M, 220; 361/800, 748
See application file for complete search history.

(56) References Cited

U.S. PATENT DOCUMENTS

2004/0012840 A1 1/2004 Takiguchi et al.
2004/0178472 A1* 9/2004 Zhang ..... H01L 23/552 257/531
2006/0038621 A1* 2/2006 Shiramizu ..... H01L 23/5227 331/36 L
2013/0049919 A1* 2/2013 Cho ..... H01F 17/0013 336/84 C
2015/0381135 A1 12/2015 Tsai et al.

FOREIGN PATENT DOCUMENTS

CN 101065846 A 10/2007
JP 06-176928 A * 6/1994
TW 515054 B 12/2002
TW 200926395 A 6/2009

OTHER PUBLICATIONS

Hsiao-Tsung Yen et al., "Electronic Apparatus and Electromagnetic Radiation Suppression Method", U.S. Appl. No. 14/876,835, filed Oct. 7, 2015.

* cited by examiner

*Primary Examiner* — Mangtin Lian
(74) *Attorney, Agent, or Firm* — CKC & Partners Co., Ltd.

(57) ABSTRACT

An integrated circuit includes a first inductor, a second inductor, and a blocker. The first inductor is disposed in a metal layer, and the second is disposed in the metal layer. The blocker is disposed on the metal layer and located between the first inductor and the second inductor. The blocker is configured to block coupling occurring between the first inductor and the second inductor.

18 Claims, 7 Drawing Sheets

INTEGRATED CIRCUIT

RELATED APPLICATIONS

This application claims priority to Taiwanese Application Serial Number 104135797, filed Oct. 30, 2015, which is herein incorporated by reference.

BACKGROUND

Field of Invention

The present disclosure relates to an electronic circuitry. More particularly, the present disclosure relates to an integrated circuit.

Description of Related Art

Coupling phenomena is often relevant to inductors and wires of integrated circuits. For example, coupling phenomena may occur between two inductors, between two wires or between an inductor and a wire. Coupling phenomena are particularly problematic in high-frequency ranges, e.g., frequencies between 5 GHz-10 GHz or frequencies higher than 10 GHz, which severely affects the performance of the integrated circuits.

With respect to the coupling phenomenon occurring between two inductors, since the trend of development in integrated circuit manufacturing processes is miniaturization of the integrated circuits, the distances respectively between pairs of inductors in an integrated circuit are becoming smaller. Therefore, the coupling phenomenon occurring between pairs of inductors is getting more apparent.

In view of the foregoing, problems and disadvantages are associated with existing products that require further improvement. However, those skilled in the art have yet to find a solution.

SUMMARY

The following presents a simplified summary of the disclosure in order to provide a basic understanding to the reader. This summary is not an extensive overview of the disclosure and it does not identify key/critical elements of the present disclosure or delineate the scope of the present disclosure.

One aspect of the present disclosure is directed to an integrated circuit. The integrated circuit includes a first inductor, a second inductor, and a blocker. The first inductor is disposed in a metal layer. The second inductor is disposed in the metal layer. The blocker is disposed on the metal layer, and between the first inductor and the second inductor. The blocker is configured to block coupling occurring between the first inductor and the second inductor.

Another aspect of the present disclosure is directed to an integrated circuit. The integrated circuit includes a first inductor, a second inductor, and a current ring. The first inductor is disposed in a metal layer. The second inductor is disposed in the metal layer. The current ring is disposed on the metal layer, and between the first inductor and the second inductor. The current ring is located on a plane, and the plane is approximately perpendicular to the metal layer.

In view of the foregoing, embodiments of the present disclosure provide an integrated circuit to improve coupling phenomenon problems occurring between inductors and thereby enhance the performance of the integrated circuit.

These and other features, aspects and advantages of the present disclosure, as well as the technical means and embodiments employed by the present disclosure, are better understood with reference to the following description in connection with the accompanying drawings and appended claims.

BRIEF DESCRIPTION OF THE DRAWINGS

The disclosure can be more fully understood by reading the following detailed description of the embodiments, with reference made to the accompanying drawings as follows.

Figure 1:
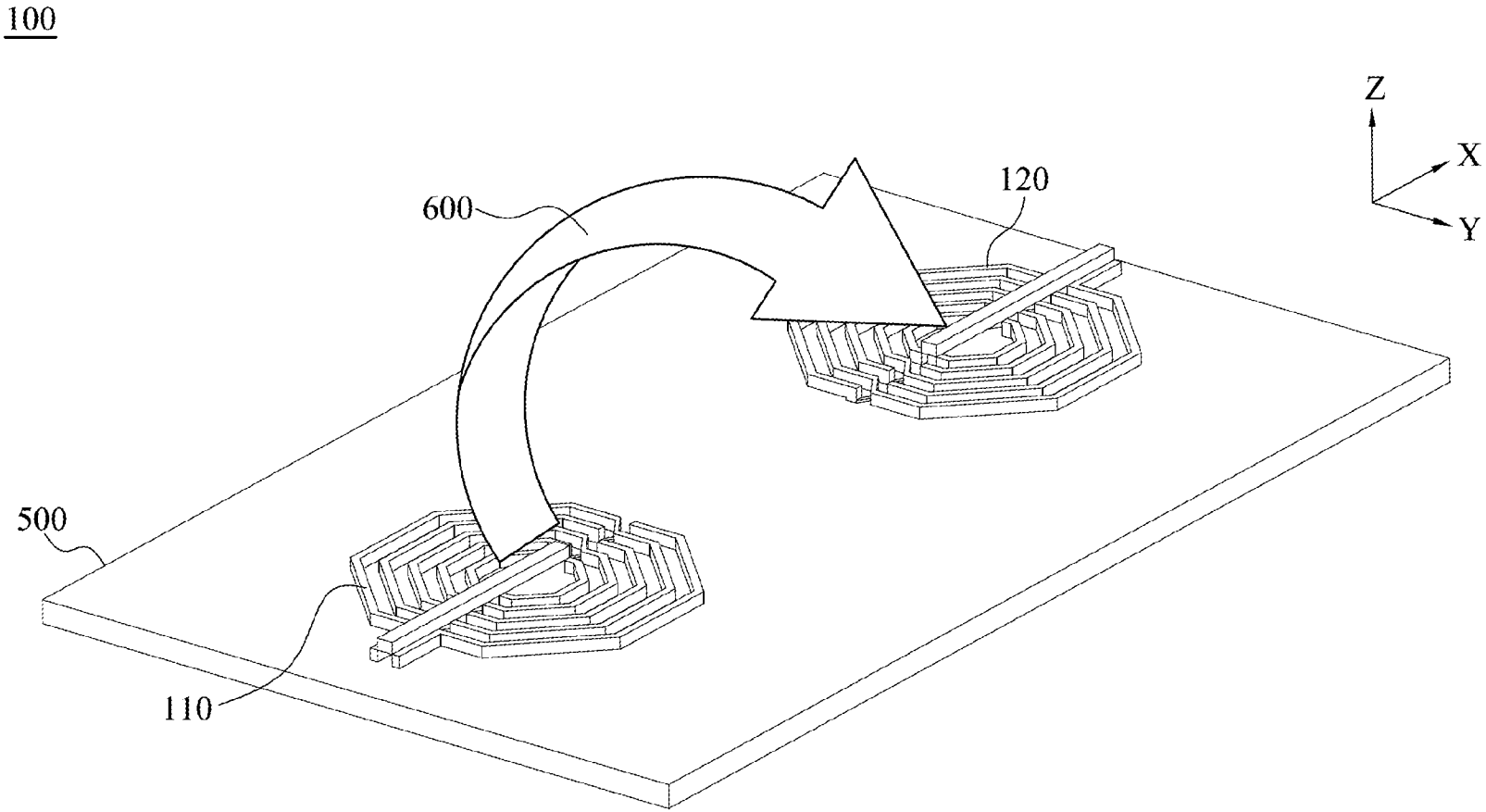
FIG. 1 is a schematic diagram of an integrated circuit according to embodiments of the present disclosure.

In accordance with common practice, the various described features/elements are not drawn to scale but instead drawn to best illustrate specific features/elements relevant to the present disclosure. Also, wherever possible, like or the same reference numerals are used in the drawings and the description to refer to the same or like parts.

DETAILED DESCRIPTION

The detailed description provided below in connection with the appended drawings is intended as a description of the present examples and is not intended to represent the only forms, in which the present example may be constructed or utilized. The description sets forth the functions of the example and the sequence of steps for constructing and operating the example. However, the same or equivalent functions and sequences may be accomplished by different examples.

Unless otherwise defined herein, scientific and technical terminologies employed in the present disclosure shall have the meanings that are commonly understood and used by one of ordinary skill in the art. Unless otherwise required by context, it will be understood that singular terms shall include plural forms of the same and plural terms shall include singular forms of the same.

FIG. 1 is a schematic diagram of an integrated circuit according to embodiments of the present disclosure. As shown in the figure, the integrated circuit 100 comprises an inductor 110 and an inductor 120. The inductor 110 and the inductor 120 are disposed on a metal layer 500. When the integrated circuit 100 operates, coupling 600 occurs between the inductor 110 and the inductor 120 in the Z-axis direction and thereby affects the performance of the integrated circuit 100.

Figure 2:
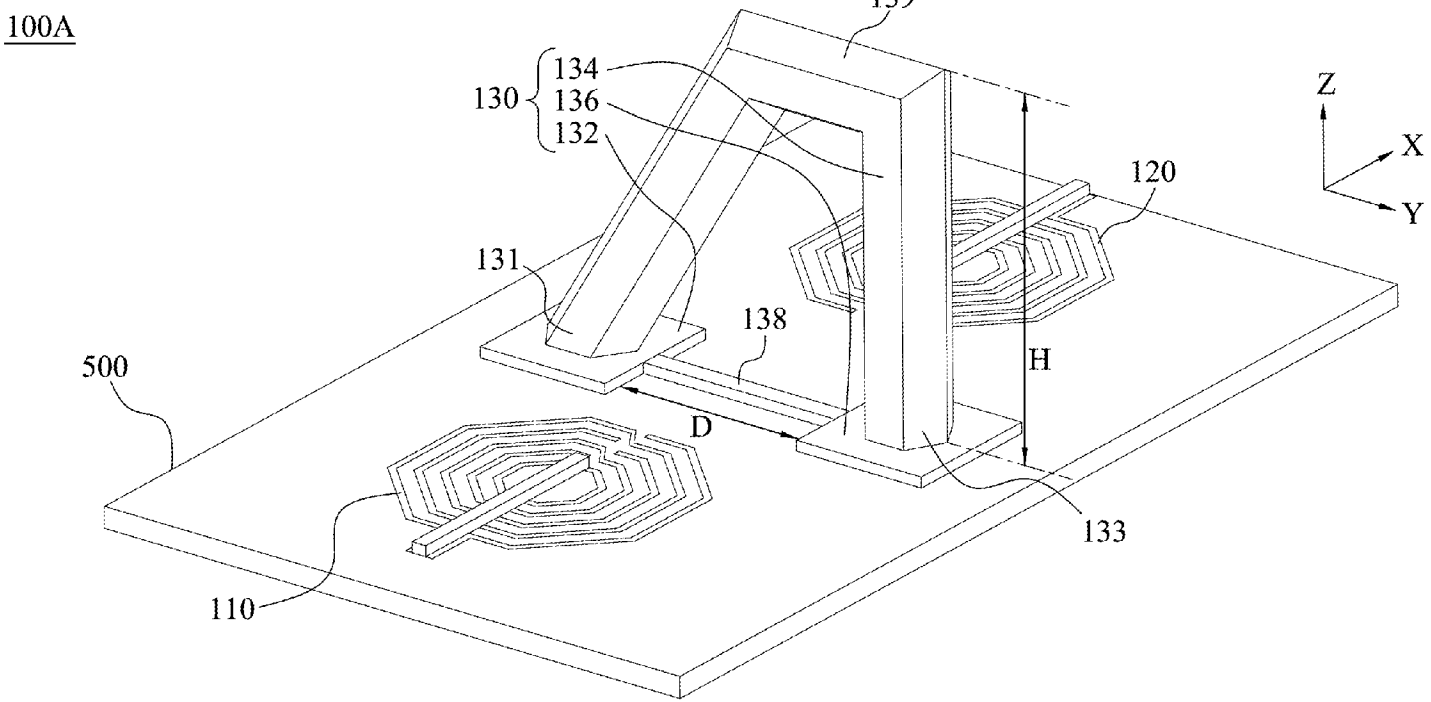
FIG. 2 is a schematic diagram of an integrated circuit according to embodiments of the present disclosure.

FIG. 2 is a schematic diagram of an integrated circuit according to embodiments of the present disclosure. Compared with the integrated circuit 100 as shown in FIG. 1, the integrated circuit 100A in FIG. 2 further comprises a blocker 130. The blocker 130 is disposed on the metal layer 500 and between the inductor 110 and the inductor 120. The blocker 130 blocks coupling occurring between the inductor 110 and the inductor 120. For example, the blocker 130 may be configured to block coupling 600 occurring between the inductor 110 and the inductor 120 of FIG. 1.

In one embodiment, the blocker 130 may be a current ring. As shown in FIG. 2, the current ring 130 is located on a plane, e.g., the YZ plane. The plane is approximately perpendicular to the metal layer 500. Through such a configuration, when the integrated circuit 100A operates, coupling occurring between the inductor 110 and the inductor 120 in the Z-axis direction is blocked by the current ring 130 so as to improve the problem of lowered performance of the integrated circuit 100A caused by inductor coupling. Since the current ring 130 forms a closed loop, a magnetic field generated by the inductors 110, 120 passing through the current ring 130 generates an induced magnetic field in the current ring 130 to resist the magnetic field generated by the inductors 110, 120. Therefore, the problem of the coupling phenomenon occurring between the inductor 110 and the inductor 120 can be resolved so as to enhance the performance of the integrated circuit 100A.

In some embodiments, the current ring 130 may be coupled to ground or may be floating depending on actual requirements. In some embodiments, the current ring 130 may be a polygon current ring. The height H of the polygon current ring 130 is from the metal layer 500 to the top 139 of the polygon current ring 130. The height H is about 50 μm to 200 μm. In another embodiment, the height H is about 80 μm to 135 μm.

In some embodiments, the diameter of the polygon current ring 130 is about 15 μm to 35 μm. In another embodiment, the diameter of the polygon current ring 130 is about 18 μm to 25 μm.

As shown in FIG. 2, the current ring 130 comprises a pad 132, a wire 134 and a pad 136. The pad 132 is coupled to the pad 136. For example, the pad 132 may be coupled to the pad 136 through a connection line 138. In addition, the wire 134 comprises a first terminal 131 and a second terminal 133. The first terminal 131 is coupled to the pad 132, and the second terminal 133 is coupled to the pad 136.

In one embodiment, the height H of the wire 134 is from the pad 136 to the top 139 of the wire 134. The height H is about 50 μm to 200 μm. In another embodiment, the height H is about 80 μm to 135 μm.

In some embodiments, the distance D between the pad 132 and the pad 136 is about 71 μm to 171 μm. In some embodiments, the first terminal 131 of the wire 134 and the pad 132 are coupled at a first point, the second terminal 133 of the wire 134 and the pad 136 are coupled at a second point, and a distance between the first point and the second point is about 71 μm to 171 μm.

In an optional embodiment, the diameter of the wire 134 is about 15 μm to 35 μm. In another embodiment, the diameter of the wire 134 is about 18 μm to 25 μm.

Figure 3:
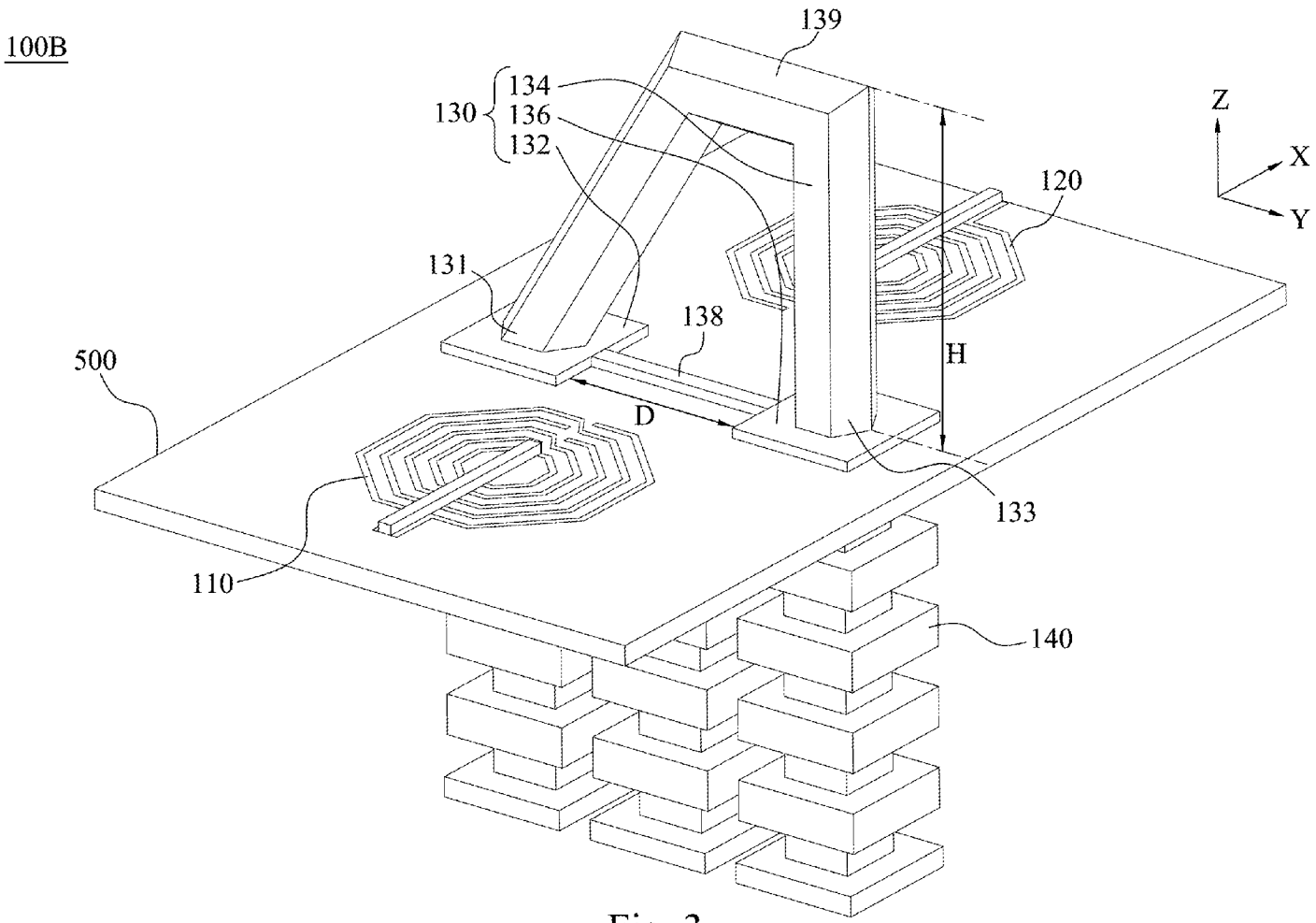
FIG. 3 is a schematic diagram of an integrated circuit according to embodiments of the present disclosure.

FIG. 3 is a schematic diagram of an integrated circuit according to embodiments of the present disclosure. Compared with the integrated circuit 100A of FIG. 2, the integrated circuit 100B of FIG. 3 further comprises a rail 140. The rail 140 is disposed under the metal layer 500, and between the inductor 110 and the inductor 120. As a result, when the integrated circuit 100B operates, coupling occurring between the inductor 110 and the inductor 120 is not only blocked by the current ring 130, but also blocked by the rail 140, such that the problem of reduced performance of the integrated circuit 100B caused by inductor coupling can be resolved.

In some embodiments, the rail 140 may be regarded as a vertical patterned ground shielding (PGS).

Figure 4:
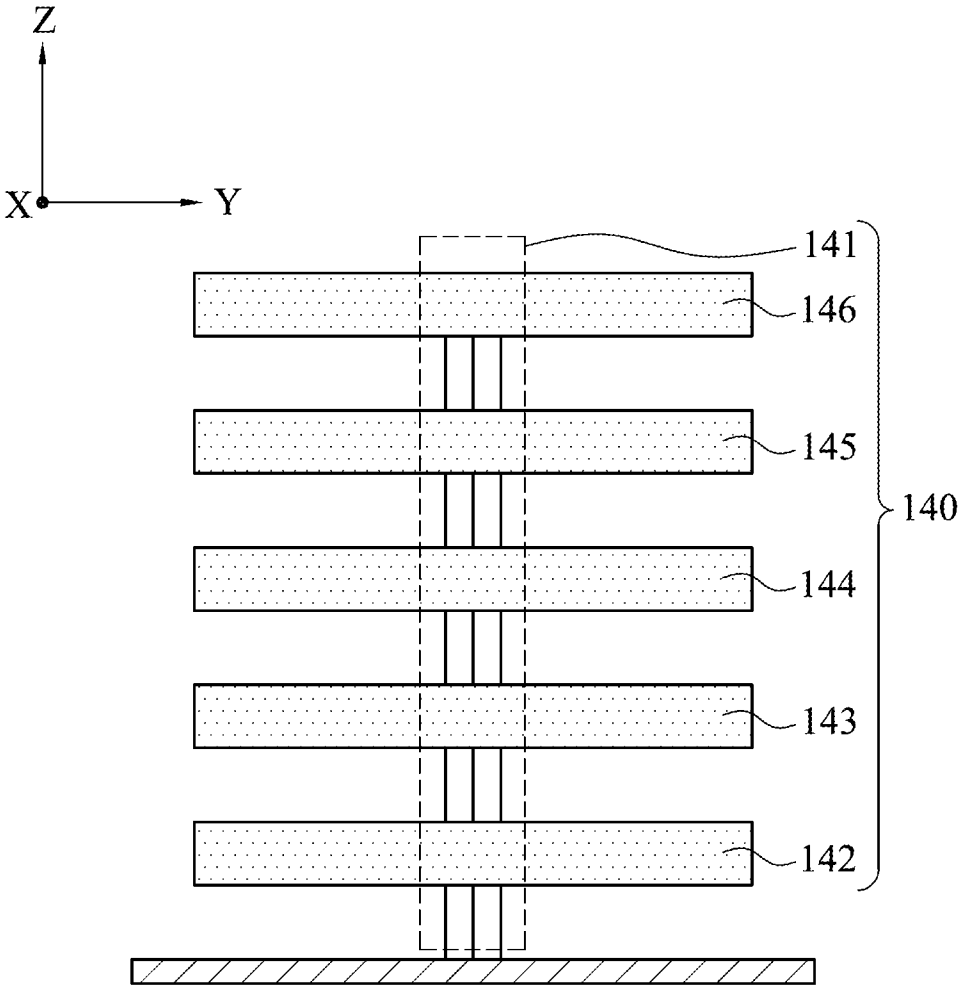
FIG. 4 is a schematic diagram of a rail of an integrated circuit in FIG. 3 according to embodiments of the present disclosure.

FIG. 4 is a schematic diagram of a rail of an integrated circuit in FIG. 3 according to embodiments of the present disclosure. In this embodiment, another implementation of the rail 140 in FIG. 3 is illustrated. As shown in the figure, the rail 140 comprises a pillar 141 and a plurality of strip portions 142~146. Each of the strip portions 142~146 is coupled to the pillar 141. For example, the center part of the strip portion 142 and the center part of the strip portion 143 are coupled to the pillar 141, and the strip portion 142 and the strip portion 143 are spaced apart by a distance. The manner in which the strip portions 144~146 are disposed is similar to that of the strip portions 142~143, and a detailed description related to the strip portions 144~146 is omitted herein. In some embodiments, the pillar 141 is disposed in a first direction, e.g., a Z-axis direction, the strip portions 142~146 are disposed in a second direction, e.g., a Y direction, and the first direction is approximately perpendicular to the second direction. As shown in FIG. 4, the pillar 141 and the strip portions 142~146 of the rail 140 form a fishbone structure, and the fishbone structure may interfere with coupling occurring between the inductor 110 and the inductor 120. Therefore, the problem of lowered performance of the integrated circuit 100B caused by inductor coupling can be further resolved.

Figure 5:
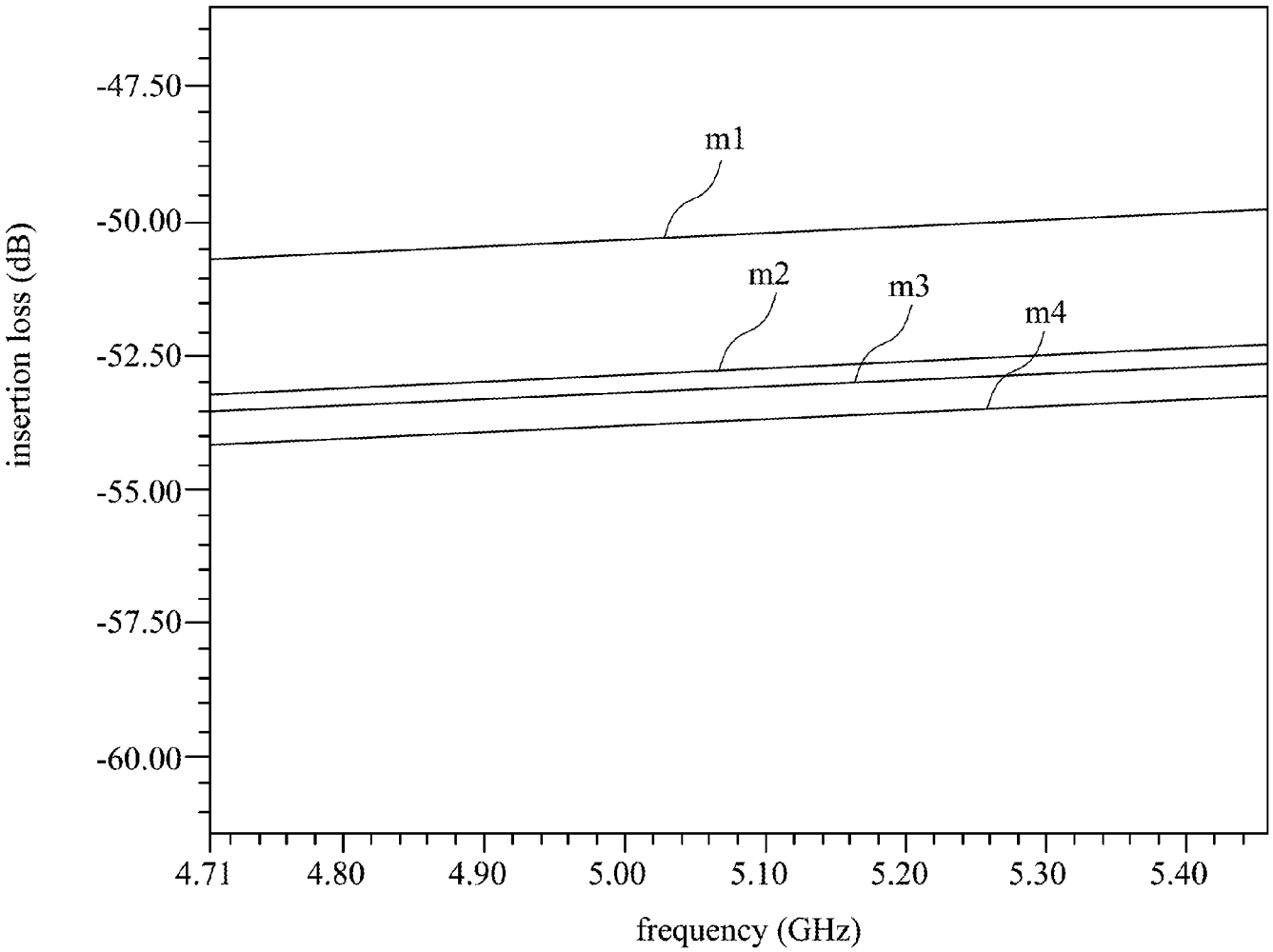
FIG. 5 is an experimental data diagram of an integrated inductor structure according to embodiments of the present disclosure.

FIG. 5 is an experimental data diagram of an integrated circuit according to embodiments of the present disclosure. This experimental data diagram is used for describing the insertion loss among the inductors in the integrated circuit when the integrated circuit operates in different frequencies. As shown in the figure, the curve m1 represents experimental data if the blocker, e.g., a current ring, is not used in the integrated circuit. The curves m2~m4 represent experimental data if the blocker is used in the integrated circuit of embodiments of the present disclosure. Specifically, the curve m2 represents experimental data if the blocker with a height of 80 μm is used in the integrated circuit. The curve m3 represents experimental data if the blocker with a height of 200 μm is used in the integrated circuit. The curve m4 represents experimental data if the blocker with a height of 135 μm is used in the integrated circuit. As can be seen from FIG. 5, coupling values of curves m2~m4 are lower than the coupling value of the curve m1. As a result, the experimental data shows that the integrated circuit of embodiments of the present disclosure indeed can reduce coupling values among inductors, in which the maximum reduced coupling value is 3.5 dB. Therefore, the problem of lowered performance of the integrated circuit caused by inductor coupling can be resolved. However, the present disclosure is not limited to the foregoing embodiments, and a person skilled in the art may change parameters, e.g., the height of the blocker, of the integrated circuit for achieving the best performance.

Figure 6:
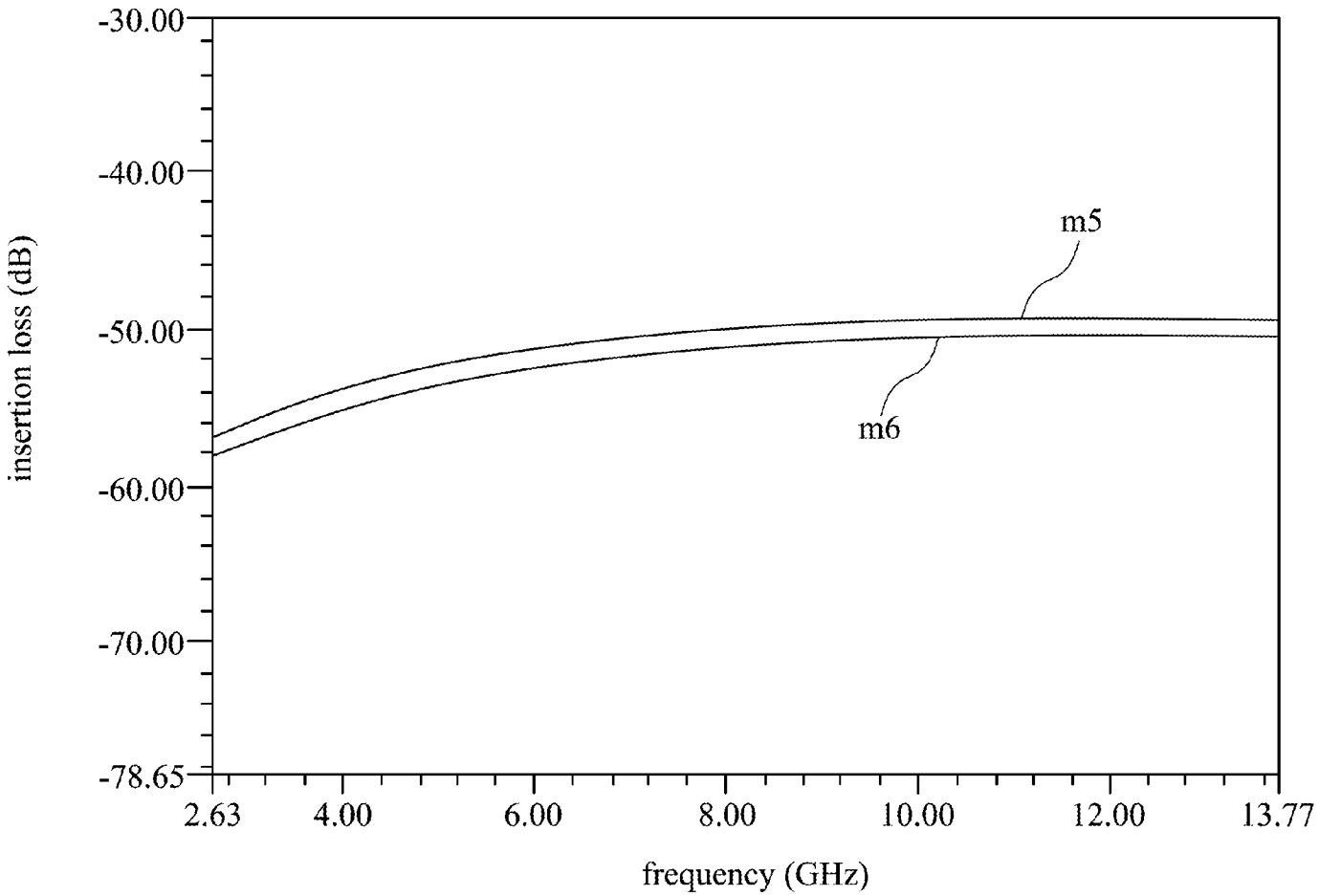
FIG. 6 is an experimental data diagram of an integrated inductor structure according to embodiments of the present disclosure.

FIG. 6 is an experimental data diagram of an integrated inductor structure according to embodiments of the present disclosure. This experimental data diagram is used for describing the insertion loss among the inductors in the integrated circuit when the integrated circuit operates in different frequencies. As shown in the figure, the curves m5~m6 represent experimental data if the blocker, e.g., the current ring, is used in the integrated circuit of embodiments of the present disclosure. Specifically, the curve m5 represents experimental data if the integrated circuit adopts a blocker in which a distance between the two terminals of the wire is 71 μm. The curve m6 represents experimental data if the integrated circuit adopts a blocker in which a distance between the two terminals of the wire is 171 μm. As can be seen from FIG. 6, coupling values of curves m5~m6 are lower than the coupling value of the curve m1. As a result, the experimental data shows that the integrated circuit of embodiments of the present disclosure indeed can reduce coupling values among inductors. Therefore, the problem of lowered performance of the integrated circuit caused by inductor coupling can be resolved. However, the present disclosure is not limited to the foregoing embodiments, and a person skilled in the art may change parameters, e.g., the height of the blocker, of the integrated circuit for achieving the best performance.

Figure 7:
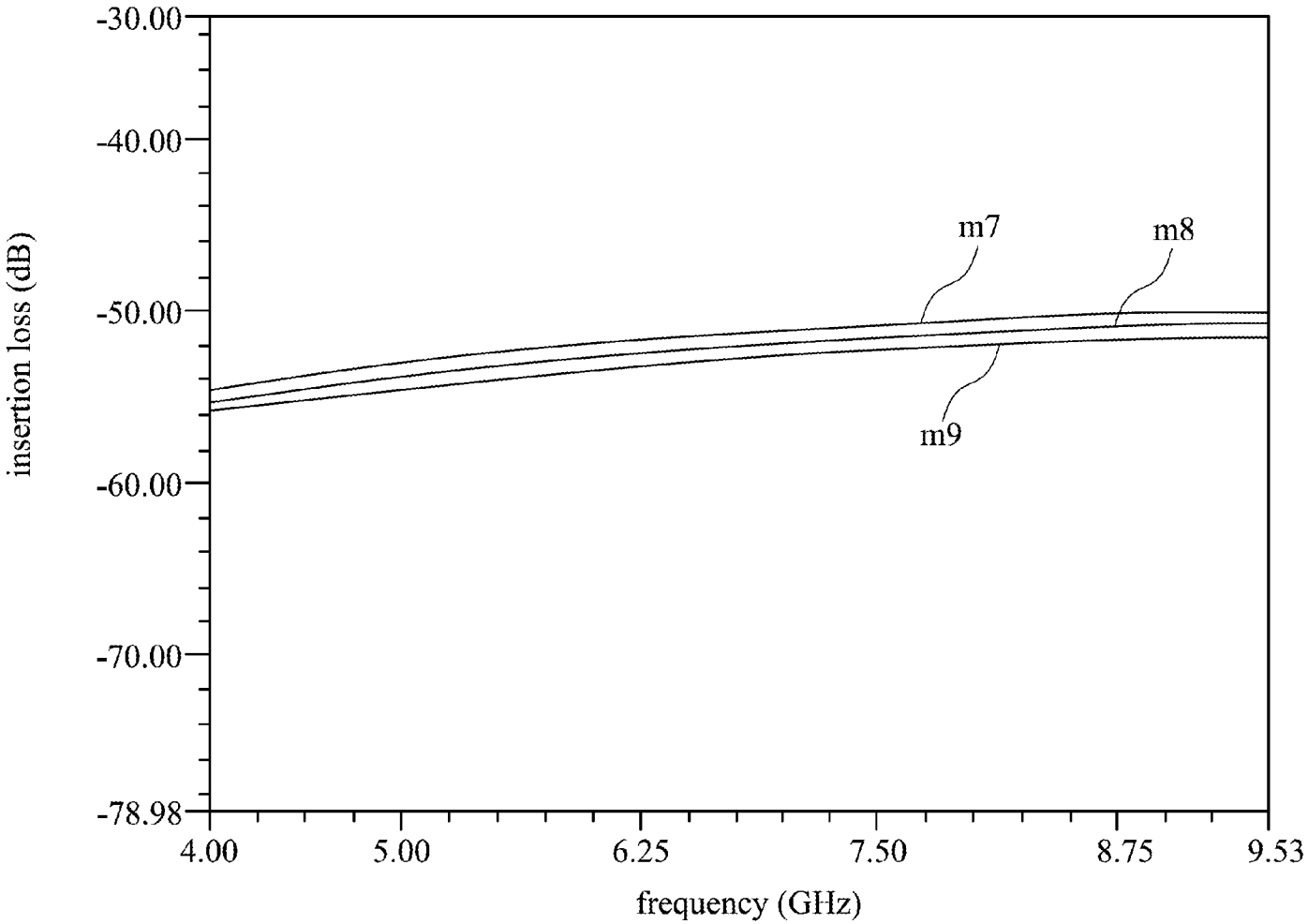
FIG. 7 is an experimental data diagram of an integrated inductor structure according to embodiments of the present disclosure.

FIG. 7 is an experimental data diagram of an integrated inductor structure according to embodiments of the present disclosure. This experimental data diagram is used for describing the insertion loss among the inductors in the integrated circuit when the integrated circuit operates in different frequencies. As shown in the figure, the curves m7~m9 represent experimental data if the blocker, e.g., the current ring, is used in the integrated circuit of embodiments of the present disclosure. Specifically, the curve m7 represents experimental data if the integrated circuit adopts a blocker in which its diameter is 18 μm. The curve m8 represents experimental data if the integrated circuit adopts a blocker in which its diameter is 25 μm. The curve m9 represents experimental data if the integrated circuit adopts a blocker in which its diameter is 35 μm. As can be seen from FIG. 7, coupling values of curves m7~m9 are lower than the coupling value of the curve m1. As a result, the experimental data shows that the integrated circuit of embodiments of the present disclosure indeed can reduce coupling values among inductors. Therefore, the problem of lowered performance of the integrated circuit caused by inductor coupling can be resolved. However, the present disclosure is not limited to the foregoing embodiments, and a person skilled in the art may change parameters, e.g., the height of the blocker, of the integrated circuit for achieving the best performance.

In view of the above embodiments of the present disclosure, it is apparent that the application of the present disclosure has a number of advantages. Embodiments of the present disclosure provide an integrated circuit to improve coupling phenomenon problems occurring among inductors and thereby enhance the performance of integrated circuits.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. An integrated circuit, comprising:
a first inductor, disposed in a metal layer;
a second inductor, disposed in the metal layer; and
a blocker, disposed on the metal layer and between the first inductor and the second inductor, wherein the blocker is configured to block coupling occurring between the first inductor and the second inductor;
wherein the blocker is located on a plane and forms a closed loop on the plane, and the plane is approximately perpendicular to the metal layer,
wherein the blocker comprises:
a first pad;
a second pad, coupled to the first pad through a connecting line; and
a wire comprising:
a first terminal, coupled to the first pad; and
a second terminal, coupled to the second pad.

2. The integrated circuit of claim 1, wherein the blocker is coupled to ground or is floating.

3. The integrated circuit of claim 1, wherein a height of the wire is about 50 μm to 200 μm, and the height of the wire is from the first pad to a top of the wire.

4. The integrated circuit of claim 1, wherein a distance between the first pad and the second pad is about 71 μm to 171 μm.

5. The integrated circuit of claim 1, wherein a diameter of the wire is about 15 μm to 35 μm.

6. The integrated circuit of claim 1, further comprising:
a rail, disposed under the metal layer and between the first inductor and the second inductor.

7. The integrated circuit of claim 6, wherein the rail comprises:
a pillar; and
a plurality of strip portions, wherein each of the strip portions is coupled to the pillar.

8. The integrated circuit of claim 7, wherein the pillar is disposed in a first direction, the strip portions are disposed in a second direction, and the first direction is approximately perpendicular to the second direction.

9. An integrated circuit, comprising:
a first inductor, disposed in a metal layer;
a second inductor, disposed in the metal layer; and
a current ring, disposed on the metal layer and between the first inductor and the second inductor, wherein the current ring is located on a plane and forms a closed loop on the plane, and the plane is approximately perpendicular to the metal layer wherein the current ring comprises:
a first pad;
a second pad, coupled to the first pad through a connecting line; and
a wire comprising:
a first terminal, coupled to the first pad; and
a second terminal, coupled to the second pad.

10. The integrated circuit of claim 9, wherein the current ring is coupled to ground or is floating.

11. The integrated circuit of claim 9, wherein the current ring comprises a polygon current ring, wherein a height of the polygon current ring is about 50 μm to 200 μm, and the height of the current polygon current ring is from the metal layer to a top of the polygon current ring.

12. The integrated circuit of claim 11, wherein a diameter of the polygon current ring is about 15 μm to 35 μm.

13. The integrated circuit of claim 9, wherein a height of the wire is about 50 μm to 200 μm, and the height of the wire is from the first pad to a top of the wire.

14. The integrated circuit of claim 9, wherein a distance between the first pad and the second pad is about 71 μm to 171 μm.

15. The integrated circuit of claim 9, wherein a diameter of the wire is about 15 μm to 35 μm.

16. The integrated circuit of claim 9, further comprising:
a rail, disposed under the metal layer and between the first inductor and the second inductor.

17. The integrated circuit of claim 16, wherein the rail comprises:
a pillar; and
a plurality of strip portions, wherein each of the strip portions is coupled to the pillar.

18. The integrated circuit of claim 17, wherein the pillar is disposed in a first direction, the strip portions are disposed in a second direction, and the first direction is approximately perpendicular to the second direction.

* * * * *